US007699112B2

(12) United States Patent
Galloway

(10) Patent No.: US 7,699,112 B2
(45) Date of Patent: Apr. 20, 2010

(54) SIDETRACK OPTION FOR MONOBORE CASING STRING

(75) Inventor: Gregory Guy Galloway, Conroe, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 170 days.

(21) Appl. No.: 11/418,575

(22) Filed: May 5, 2006

(65) Prior Publication Data

US 2007/0256841 A1 Nov. 8, 2007

(51) Int. Cl.
*E21B 19/16* (2006.01)

(52) U.S. Cl. ..... 166/380; 166/50; 166/207

(58) Field of Classification Search ..... 166/380, 166/313, 50, 207, 117.6, 242.6; 138/98
See application file for complete search history.

(56) References Cited

U.S. PATENT DOCUMENTS

| | | | | |
|---|---|---|---|---|
| 4,754,781 | A * | 7/1988 | Jan de Putter | 138/98 |
| 6,070,671 | A * | 6/2000 | Cumming et al. | 166/381 |
| 6,135,208 | A * | 10/2000 | Gano et al. | 166/313 |
| 6,158,514 | A | 12/2000 | Gano et al. | |
| 6,854,522 | B2 * | 2/2005 | Brezinski et al. | 166/387 |
| 6,883,611 | B2 * | 4/2005 | Smith et al. | 166/313 |
| 7,073,599 | B2 * | 7/2006 | Smith | 166/380 |
| 7,077,210 | B2 * | 7/2006 | MacKay et al. | 166/380 |
| 7,090,022 | B2 * | 8/2006 | Smith et al. | 166/380 |
| 7,117,940 | B2 * | 10/2006 | Campo | 166/207 |
| 2003/0192717 | A1 | 10/2003 | Smith et al. | |
| 2004/0168809 | A1 * | 9/2004 | Nobileau | 166/313 |
| 2005/0001429 | A1 | 1/2005 | Simpson | |
| 2005/0011650 | A1 * | 1/2005 | Harrall et al. | 166/380 |
| 2005/0194129 | A1 * | 9/2005 | Campo | 166/207 |
| 2006/0005973 | A1 * | 1/2006 | Harrall et al. | 166/384 |

FOREIGN PATENT DOCUMENTS

| | | |
|---|---|---|
| CA | 2 356 184 | 6/2000 |
| CA | 2 453 400 | 1/2003 |
| CA | 2 471 336 | 7/2003 |
| GB | 2 410 759 | 8/2005 |
| GB | 2 433 080 | 6/2007 |
| WO | WO 99/04135 | 1/1999 |
| WO | WO 02/086286 | 10/2002 |
| WO | WO 2004/079150 | 9/2004 |

OTHER PUBLICATIONS

GB Search Report, Application No. GB0708786.9, dated Oct. 24, 2007.
GB Search Report, Application No. GB0708786.9, dated Aug. 16, 2007.
CA Official Letter, Application No. 2,587,163 dated Nov. 26, 2008.

* cited by examiner

*Primary Examiner*—David J Bagnell
*Assistant Examiner*—Sean D Andrish
(74) *Attorney, Agent, or Firm*—Patterson & Sheridan, LLP

(57) ABSTRACT

Embodiments of the present invention provide apparatus and methods of forming a lateral wellbore wherein the monobore characteristic is maintained. In one embodiment, a method of completing a lateral wellbore comprises inserting a first tubular into a main wellbore; forming one or more oversized portions on the first tubular; and intersecting the lateral wellbore with the main wellbore. The method further includes inserting a second tubular into the lateral wellbore, wherein a portion of the second tubular is positioned adjacent the one or more oversized portions and expanding the portion of the second tubular adjacent the one or more oversized portions.

41 Claims, 8 Drawing Sheets

SIDETRACK OPTION FOR MONOBORE CASING STRING

BACKGROUND OF THE INVENTION

1. Field of the Invention

Embodiments of the present invention generally relate to apparatus and methods for use in a hydrocarbon wellbore. More particularly, the invention provides apparatus and methods for completing hydrocarbon wells. Still more particularly, the invention provides apparatus and methods for forming a sidetrack wellbore from an existing wellbore that has a substantially uniform inner diameter with the existing wellbore.

2. Description of the Related Art

In the drilling of a hydrocarbon well, the borehole is physically lined with strings of tubulars (e.g., liner or casing) to prevent the walls of the borehole from collapsing and to provide a reliable path for well production fluid, drilling mud, and other fluids that are naturally present or that may be introduced into the well. In a typical liner operation, after the well is drilled to a new depth, the drill bit and drill string are removed and a string of tubulars is lowered into the well to a predetermined position whereby the top of the string is at about the same height as the bottom of the existing string of tubular. Thereafter, with the new string of tubular held in place either temporarily or with some mechanical hanger, a column of cement is pumped into the tubular and forced to the bottom of the borehole where it flows out of the tubular and flows upwards into an annulus defined by the borehole and the tubular. The two principal functions of the cement between the tubular and the borehole are to restrict fluid movement between formations and to support the tubular and borehole.

To save time and money, apparatus to facilitate cementing are often lowered into the borehole along with the tubular to be cemented. Cementing apparatus typically includes a number of different components made up at the surface prior to run-in. These include a tapered nose portion located at the downhole end of the tubular to facilitate insertion thereof into the borehole. A check valve at least partially seals the end of the tubular and prevents entry of well fluid during run-in while permitting cement to subsequently flow outwards. The same valve or another valve or plug typically located in a baffle collar above the cementing tool prevents the cement from back flowing into the tubular. Components of the cementing apparatus are made of fiberglass, plastic, or other drillable material, that, like cement remaining in the tubular, can be drilled when the cementing is complete and the borehole is drilled to a new depth.

Historically, each section of tubular inserted to line a borehole was necessarily smaller in diameter than the section of tubular previously inserted. In this manner, a wellbore was formed of sequential strings of tubular of an ever-decreasing inner and outer diameter. Recently, methods and apparatus for expanding the diameter of tubular in a wellbore have advanced to the point where it has become commercially feasible to utilize the technology. This has led to the idea of monobore wells wherein through the expansion of tubulars in the wellbore, the wellbore remains at about the same diameter throughout its length. The advantages of the monobore well are obvious. The tubulars lining the borehole, and therefore the possible path for fluid in and out of the well remains consistent regardless of well depth. Additionally, tools and other devices can more easily be run into the well without regard for the smaller diameters of tubulars encountered on the way to the bottom of the wellbore.

In a monobore well, a first string of tubulars is inserted into the wellbore and cemented therein in a conventional manner. Thereafter, a string of tubulars having a smaller diameter is inserted into the wellbore as in prior art methods. However, after insertion into the wellbore the second string of tubulars is expanded to approximately the same inner and outer diameter as the first string. The strings can be connected together by use of a conventional hanger or, more typically, the smaller tubular is simply expanded into the interior of the larger diameter tubular thereabove in an area where the tubulars overlap.

With the advent of monobore wells, certain problems have arisen. One problem relates to maintaining the monobore when a sidetrack is necessary. Current methods of expanding tubulars in a wellbore to create a connection between tubulars require the application of a radial force to the interior of the smaller tubular and expanding its diameter out until the larger tubular is itself pushed passed its elastic limits. The result is a connection having an outer diameter greater than the original outer diameter of the larger tubular. While the increase in the outer diameter is minimal in comparison to the overall diameter, there are instances where expanding the diameter of the larger tubular is difficult or impossible. For example, in the completion of a monobore well, the upper string of tubulars is preferably cemented into place before the next string of tubulars is lowered into the well and its diameter expanded. Because the annular area between the outside of the larger tubular and the borehole therearound is filled with cured cement, the diameter of the larger tubular cannot be easily expanded past its original shape. Further, damage to the cement may occurred when such expansion is performed.

Therefore, a need exists for a method of maintaining the monobore when a lateral wellbore is formed.

SUMMARY OF THE INVENTION

In one embodiment, apparatus and methods are provided to form a lateral wellbore wherein the monobore characteristic is maintained.

In another embodiment, a method of completing a lateral wellbore comprises inserting a first tubular into a main wellbore; forming an oversized portion on the first tubular, wherein the oversized portion has an outer diameter that is larger than an outer diameter of a non-oversized portion; and intersecting the lateral wellbore with the main wellbore. The method further includes inserting a second tubular into the lateral wellbore, wherein a portion of the second tubular is positioned adjacent the one or more oversized portions and expanding the portion of the second tubular adjacent the one or more oversized portions.

In another embodiment, forming the one or more oversized portions comprises expanding an inner diameter of one or more portions of the first tubular. The oversized portions may be formed either before or after the first tubular is inserted into the wellbore. In another embodiment still, the method further comprises providing the first tubular with a sleeve comprising a deformable material.

In another embodiment still, the method further comprises providing the first tubular with one or more dual wall sections. The first tubular may then be expanded to form the monobore. Thereafter, the inner wall is expanded to formed the oversize portions.

In another embodiment still, a method of forming a lateral wellbore comprises inserting a first tubular into a main wellbore; forming one or more oversized portions on the first tubular; expanding the first tubular; and forming a window in the first tubular. The method further comprises forming the lateral wellbore; inserting a second tubular into the lateral wellbore; and expanding a portion of the second tubular into sealing contact with the first tubular.

In another embodiment, an apparatus for completing a wellbore comprises a first tubular with a preformed oversized portion located away from an end of the first tubular, the oversized portion configured to engage an end of a second tubular, wherein the second tubular is expanded into engagement with the oversized portion. In another embodiment, the first tubular includes a first end having a first outer diameter and a second end having a second diameter. In another embodiment still, an outer diameter of the oversized portion is greater than both the first diameter and the second diameter.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Embodiments of the present invention provide apparatus and methods of forming a lateral wellbore wherein the monobore characteristic is maintained. In one embodiment, a method of completing a lateral wellbore comprises inserting a first tubular into a main wellbore; forming one or more oversized portions on the first tubular; and intersecting the lateral wellbore with the main wellbore. The method further includes inserting a second tubular into the lateral wellbore, wherein a portion of the second tubular is positioned adjacent the one or more oversized portions and expanding the portion of the second tubular adjacent the one or more oversized portions.

Figures 1, 4, 5, 6:
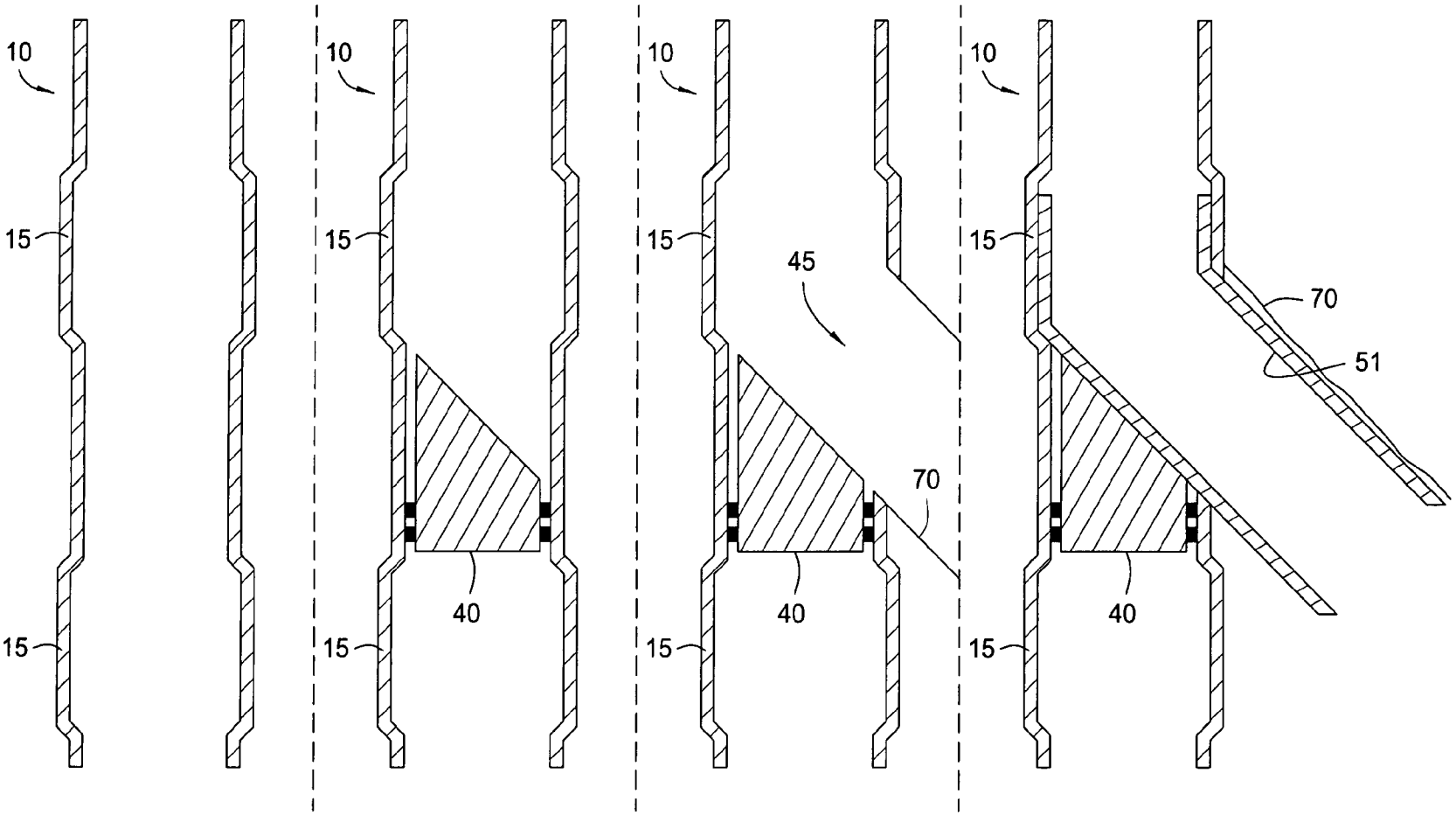
FIG. 1 is an embodiment of casing string adapted to facilitate formation of a monobore sidetrack.
FIG. 4 illustrates a whipstock installed in the casing string shown in FIG. 1
FIG. 5 illustrates a window and a sidetrack formed in the casing string shown in FIG. 1.
FIG. 6 illustrates a lateral casing lining the sidetrack formed.

FIG. 1 shows an embodiment of a casing string 10 adapted to facilitate formation of a sidetrack while maintaining monobore characteristics. The casing string 10 includes one or more oversized portions 15 along its length. The oversized portions 15 are designed to receive the sidetrack tubular, such that upon expansion, a monobore, i.e, having a substantially uniform inner diameter, is formed between the casing string 10 and the sidetrack tubular. Preferably, the oversized portion has an outer diameter that is larger than an outer diameter of the non-oversized portions of the casing string 10.

Several methods are contemplated for forming the oversized portions 15 of casing string 10. In one embodiment, the oversized portions are provided at the surface. The oversized portions may be formed by connecting an oversized casing at spaced apart intervals. A cross-over sub may be used to facilitate the connections. In another embodiment, hydroforming is used to form the oversized portions. In yet another embodiment, expander tools are used form the oversized portions. After insertion into the wellbore, expansion of the casing string may be controlled such that the oversized portions are retained in the casing string. Preferably, one or more oversized portions are formed away from ends of the casing string such that the ends of the casing string have a smaller outer diameter than an outer diameter of the oversized portion.

The oversized portions may also be formed after the casing string is disposed in the wellbore. In one embodiment, the expander tool used to expand the casing string is operated to also form the oversized portions at desired intervals. One such method of expanding the casing string to two different diameters is disclosed in U.S. Patent Publication No. 2004/0055754, which application is herein incorporated by reference in its entirety.

Figure 2:
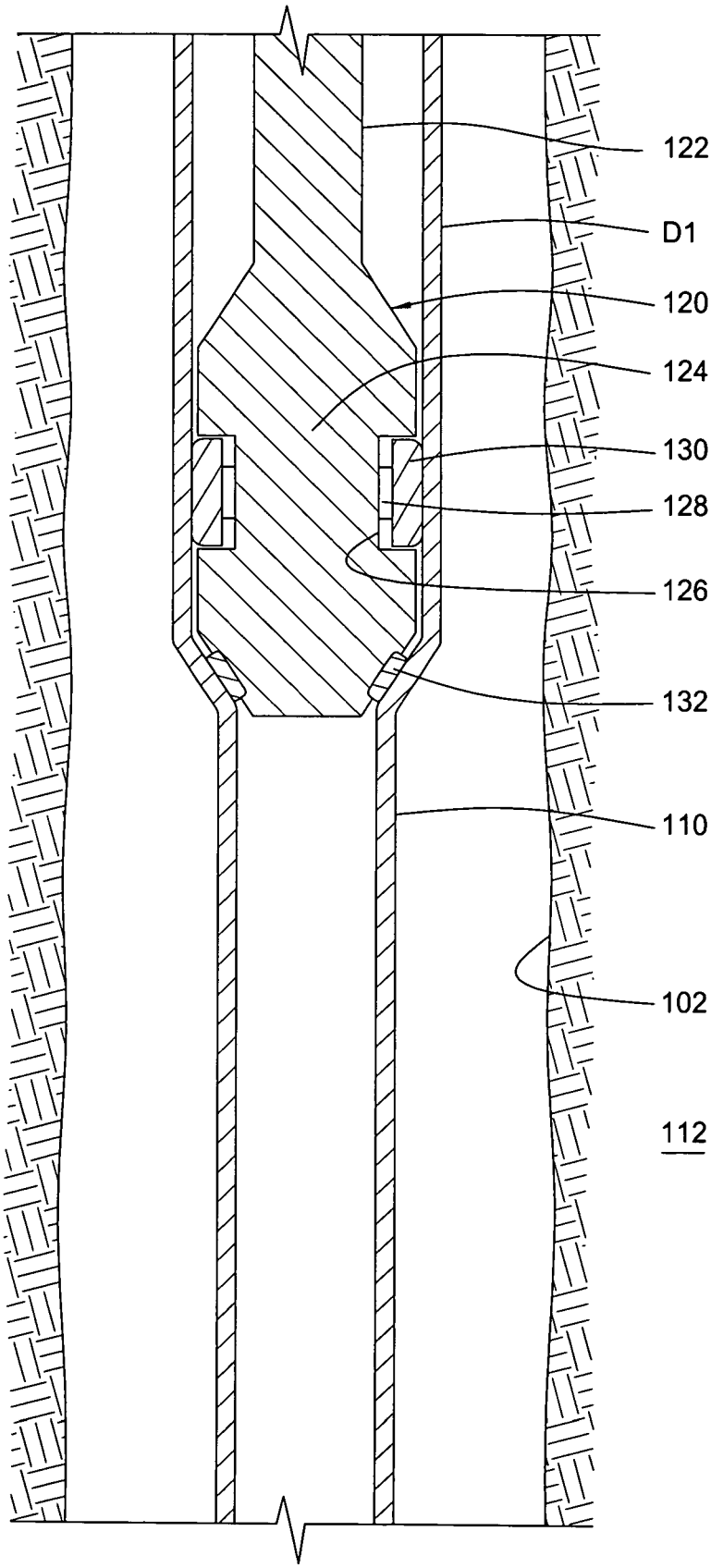
FIG. 2 illustrates a casing string being expanded into the casing string shown in FIG. 1.
Figure 3:
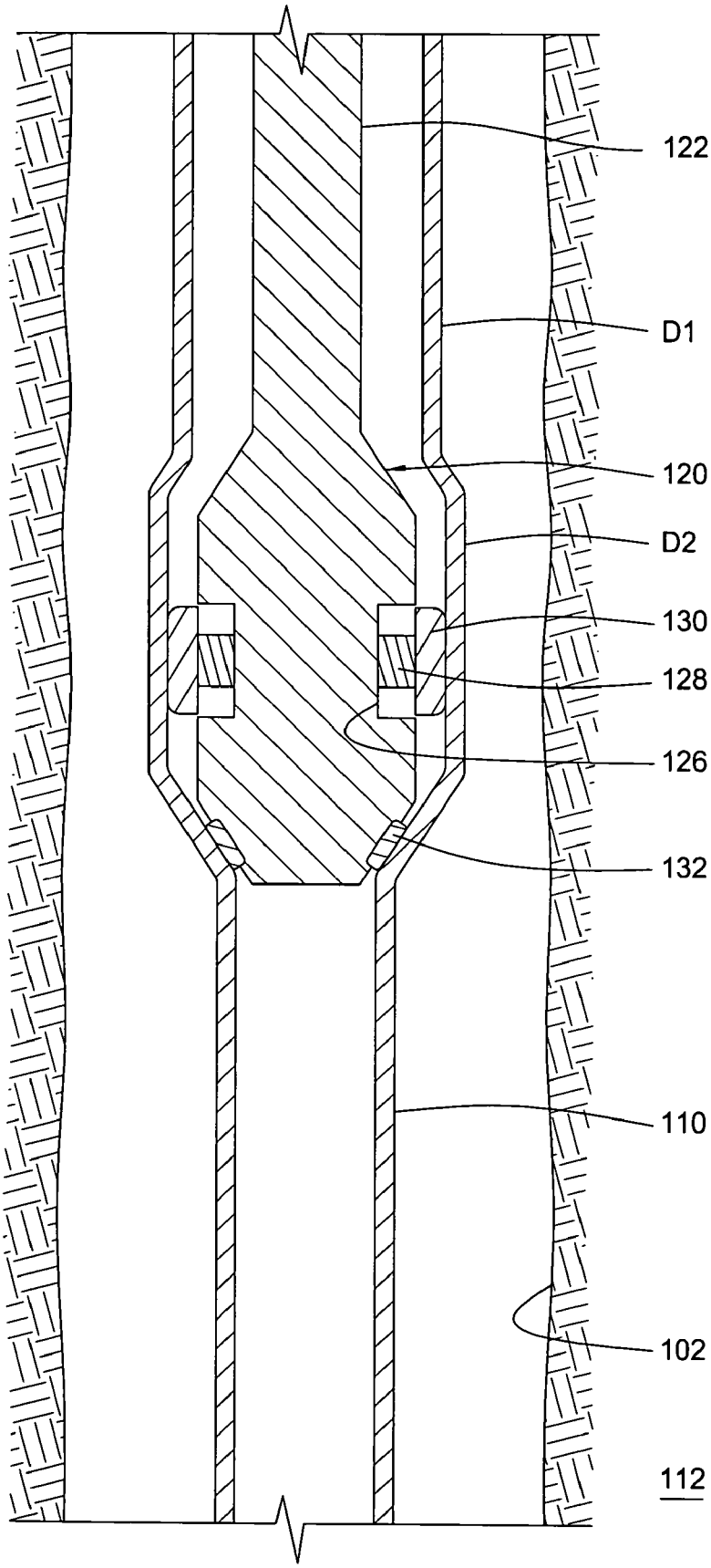
FIG. 3 illustrates a casing string being expanded into the casing string shown in FIG. 1.

FIGS. 2 and 3 illustrate a section of a wellbore 102 that has been drilled to access a subsurface hydrocarbon-bearing earth formation 112. A length of expandable tubular 110 has been run into the wellbore 102 to line the wellbore 102. As will be described, the expandable tubular 110 will be expanded to a first diameter D1 (also referred to as the "monobore diameter") to form the monobore and at least one portion of the expandable tubular 110 will be expanded to a second diameter D2 to form the oversized portion, as illustrated in FIG. 3.

As shown in FIGS. 2 and 3, the expansion is achieved using a rotary expansion tool 120 which is run into the wellbore 102 with the tubular 110, and is mounted on the lower end of a drill string 122. Of course, in other embodiments, other forms of expansion tool may be utilized, including expansion cones or mandrels, variable diameter cones, inflation tools such as an inflatable bladder, and combinations thereof. Also, fluid pressure may be utilized to at least assist in the expansion operation. The expansion tool 120 comprises a hollow body 124 defining at least one and preferably three circumferentially spaced apertures 126 which each accommodate a respective piston 128 (only two shown), each piston providing mounting for a roller 130. The tool body 124 is in fluid communication with the hollow string 122 such that hydraulic pressure may be applied to the tool body interior and thus urge the pistons 128 radially outwardly and bring the rollers 130 into contact with the tubular 110, as will be described below. In the retracted position, the outer diameter of the rollers 130 is about the same size as the monobore diameter D1. The leading end of the body 124 provides mounting for optional rollers 132 which may be radially movable or fixed in a conical configuration, the maximum diameter described by the rollers 132 being similar to the diameter described by the retracted or unextended rollers 130.

To expand the tubular 110, as illustrated in FIG. 2, the expansion tool 120 is rotated in the tubular 110 and advanced axially through the tubular 110. The rotating rollers 132 subject the tubular wall to local compressive yield, leading to a decrease in wall thickness and corresponding increase in tubular diameter. The rollers 132 are configured such that the tubular 110 tends to expand to the monobore diameter D1.

When the expansion tool 120 reaches the desired location of the oversized portion 115, pressurized fluid is supplied from surface to the expansion tool 120. The supplied pressure urges the pistons 128 and the rollers 130 radially outwards, thereby energizing the expansion tool 120, as illustrated in FIG. 2. By rotating and advancing the now energized expansion tool 120, the tubular 110 is first expanded to the diameter D1 by the action of the fixed diameter rollers 132 and then subsequently expanded to the diameter D2 by the energized rollers 130. In this manner, the oversized portions 115 may be formed. Thereafter, the rollers 130 may be de-energized and the expansion tool 120 may continue to expand the tubular 110 to the monobore diameter D1 until the next location of the oversized portion is reached. After expansion, the rollers 130 may be retracted and the expansion tool 120 retrieved to surface through the expanded tubular 110.

Those of skilled in the art will recognize that further operations will then be carried out. For example, the expanded tubular 110 may then be cemented, although it must be noted that cement may be pumped before expansion. Alternatively, the cement may be pumped before tubular expansion. Further, if the casing string includes multiple oversized portions, multiple options for the location of the window would be available.

Referring now to FIGS. 4-6, to form a sidetrack 70 (also referred to as "lateral" or "lateral wellbore"), a whipstock 40 is installed in the tubular 10 to facilitate the cutting of a window 45 for the sidetrack 70 through the tubular 10. In the preferred embodiment, the whipstock 40 is releasably attached to a lower end of the drill string (not shown) used to cut the window 45. In this respect, installation of the whipstock 40 and cutting of the window 45 can be performed in a single trip. After the whipstock 40 is installed, the drilling string is released from the whipstock 40 and the drilling member is actuated to cut the window 45. After the window 45 is formed, the drill string may continue to advance, thereby forming the lateral wellbore 70. An exemplary drill string and whipstock combination is disclosed in U.S. Pat. No. 6,454,007, issued on Sep. 24, 2002 to Bailey, which patent is herein incorporated by reference in its entirety. In another embodiment, the lateral wellbore may be drilled or extended in a second trip. It is contemplated that the window may be formed in any manner known to a person of ordinary skill in the art. In another embodiment, the tubular 10 may optionally include a profile for landing the whipstock or orienting the whipstock. In addition, the tubular 10 may optionally comprise a different material at the location of the window to facilitate the formation of the window.

After at least a portion of the lateral wellbore has been formed, an expandable tubular 51 for lining the lateral wellbore 70 is inserted into the lateral wellbore 70. An upper portion of the tubular 51 is positioned in overlapping relationship with an oversized portion 15 of the tubular 10. The expandable tubular 51 is then expanded to the monobore diameter, thereby forming the monobore with the tubular 10. In this manner, a monobore sidetrack may be formed.

Figure 7:
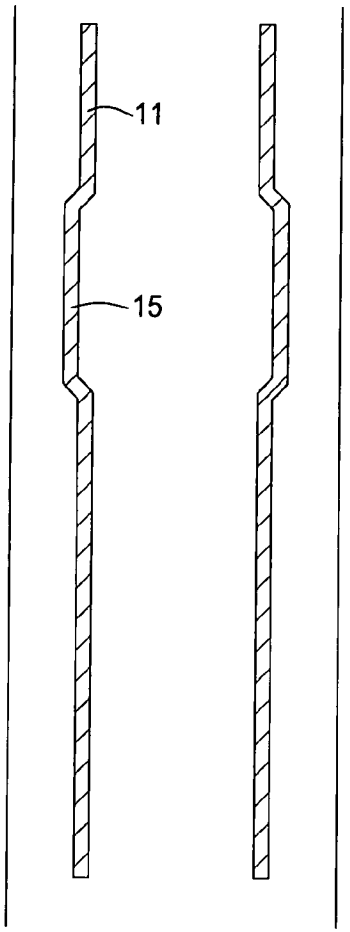
FIG. 7 illustrates an oversized portion formed in an expandable tubular.

Another method of forming the oversized portion 15 is to expand directly against the existing casing 11 in the wellbore, as illustrated in FIG. 7. In this respect, an expansion tool is inserted into the wellbore to expand a length of the casing 11. It is contemplated that the existing casing 11 may be cemented or uncemented prior to expansion. In this respect, the oversized portion may be formed in-situ at the desired location of the window. After the oversized portion 15 is formed, the methods described with respect to FIGS. 4-6 may be followed to form and line the lateral wellbore.

Figure 8:
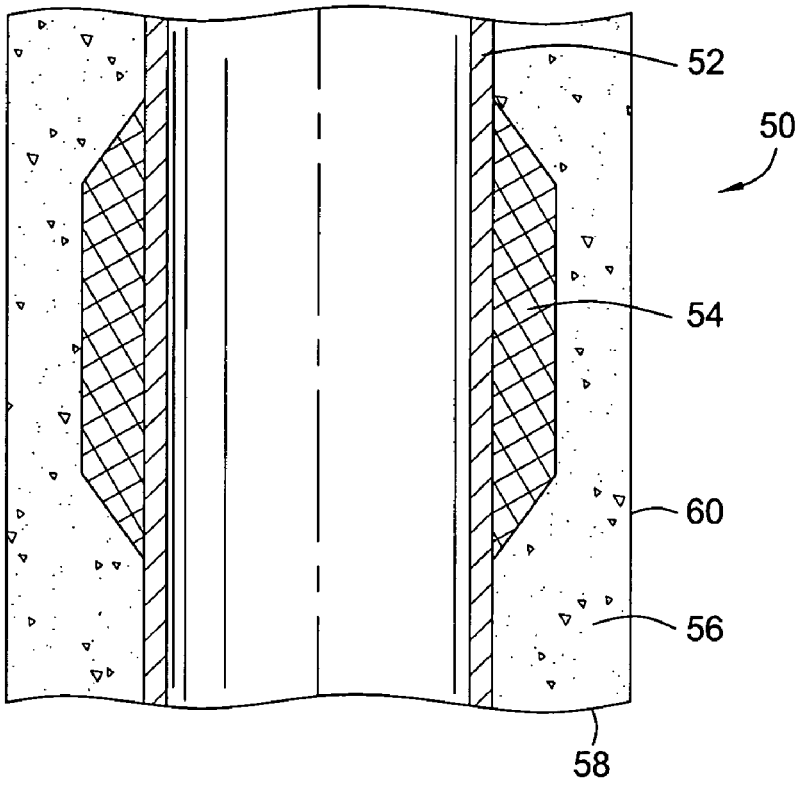
FIG. 8 illustrates another embodiment of an expandable tubular.

It is recognized that expansion of the casing in the wellbore is not always feasible. In another embodiment, the casing string may include a sleeve of a deformable material on its outer surface. An exemplary tubular having such a sleeve is disclosed in U.S. Pat. No. 6,725,917, which patent is herein incorporated by reference in its entirety. Reference is now made to FIG. 8, which is a schematic sectional view of a tubular assembly 50 for facilitating expansion of cemented tubular in accordance with an embodiment of a further aspect of the present invention. The tubular assembly 50 comprises an expandable casing 52 carrying a sleeve 54 of a deformable material. Cement slurry 56 has been circulated in the annulus 58 between the casing 52 and the wellbore wall 60 and around the sleeve 54. The cement 56 is kept spaced from the outer surface of the casing 52. However, there is sufficient spacing between the surface of the sleeve 54 and the wellbore wall 60 to allow circulation of cement slurry 56 past the sleeve 54. Indeed, the sleeve 54 may serve as a centralizer, as the tubular assembly 50 is being run in and may for example define external flutes.

To form the lateral wellbore, the casing 52 may be expanded at the location of the sleeve 54. The sleeve 54 allows for further subsequent expansion of the casing 52 in the region of the sleeve 54 after the cement has hardened. Such expansion of the casing 52 is accommodated by deformation and flow of the sleeve deformable material, as illustrated in FIG. 9.

Figure 9:
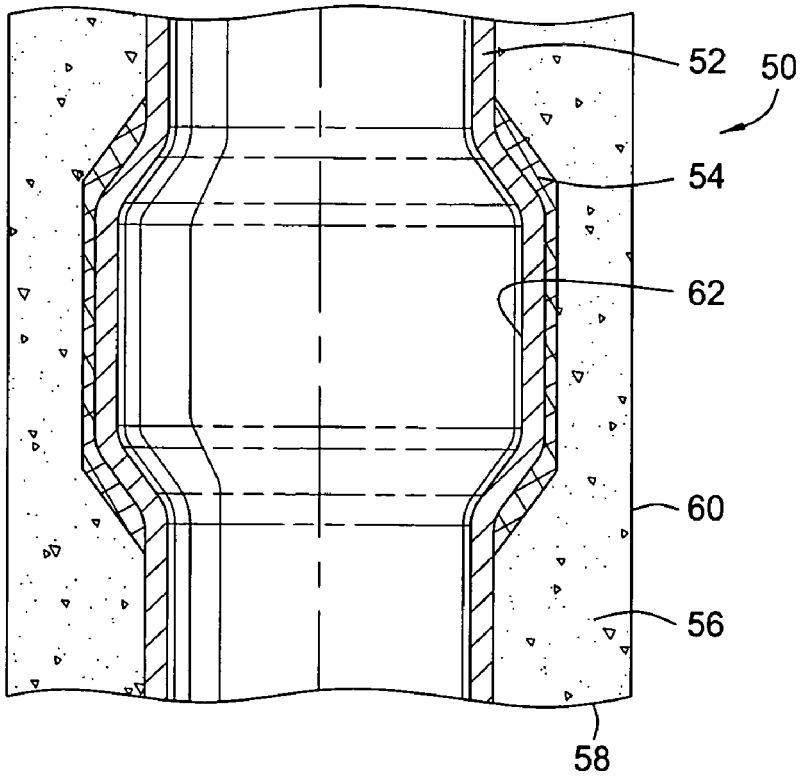
FIG. 9 illustrates the expandable tubular shown in FIG. 8 in an expanded state.

FIG. 9 illustrates a profile 62, i.e., oversized portion, which has been created by expansion of the casing 52 into the volume occupied by the sleeve 54. After the oversized portion 15 is formed, the methods described with respect to FIGS. 4-6 may be followed to form and line the lateral wellbore.

Figure 10:
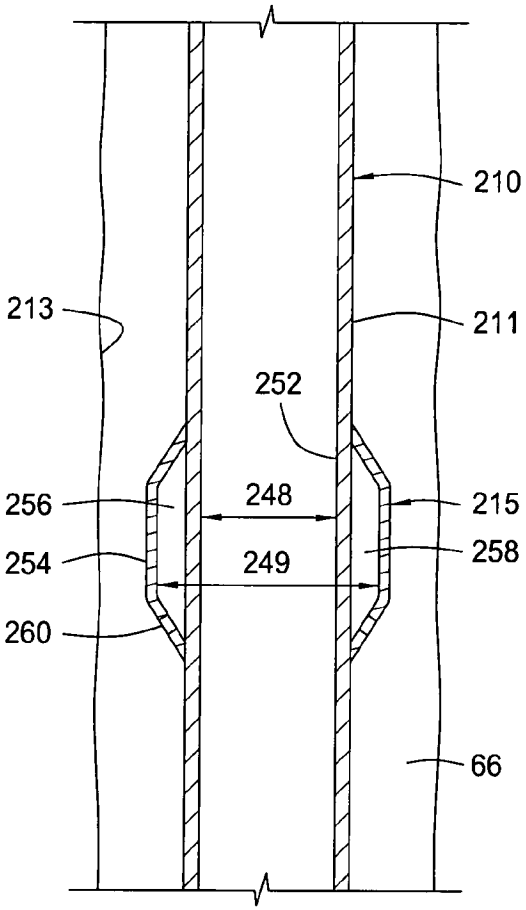
FIG. 10 illustrates another embodiment of an expandable tubular.

Reference is now made to FIG. 10 in which there is shown a cross-sectional view of an expandable tubular 210, shown located in a wellbore 213. A similar expandable tubular is disclosed in U.S. Patent Application Publication No. 2006/0005973, filed on May 27, 2005, which application is herein incorporated by reference in its entirety. The tubular 210 comprises a tube portion 211 and a body portion 215. The body portion 215 is provided to facilitate the formation of the oversized portion when a sidetrack is desired. The body portion 215 defines an inner diameter 248 and an outer diameter 249, and is adapted to be expanded to increase the inner diameter 248 while substantially maintaining the outer diameter 249, as will be described below. In the embodiment shown, the body portion 215 is located at a middle portion of the tubular 210. In another embodiment, expandable tubular 210 may include one or more body portions which may be located at any section(s) of the tubular 210.

The body portion 215 comprises an inner wall 252, an outer wall 254, and an annular chamber 256 defined between the two walls 252, 254. The inner diameter of the inner wall 252 is substantially equal to the inner diameter of the tube portion 211, and the outer diameter of the outer wall 254 is greater than the outer diameter of the tube portion 211.

In the preferred embodiment, the annular chamber 256 is filled with a substantially incompressible fluid 258, such as mineral oil, in order to provide a mechanism to expand the inner and outer walls 252, 254 simultaneously. That is, as the inner wall 252 is expanded with an expansion tool, the fluid transmits the radial forces to the outer wall 254 to be expanded. In another embodiment, the annular chamber may be filled with a deformable material, particulate material (e.g., sand), or unfilled.

Figure 11:
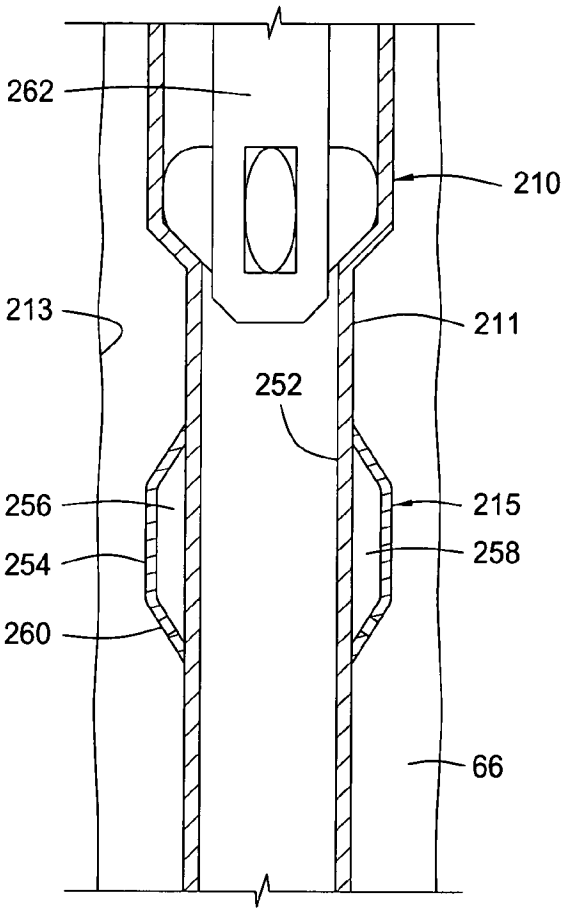
FIG. 11 illustrates an expansion tool expanding the expandable tubular of FIG. 10.
Figure 13:
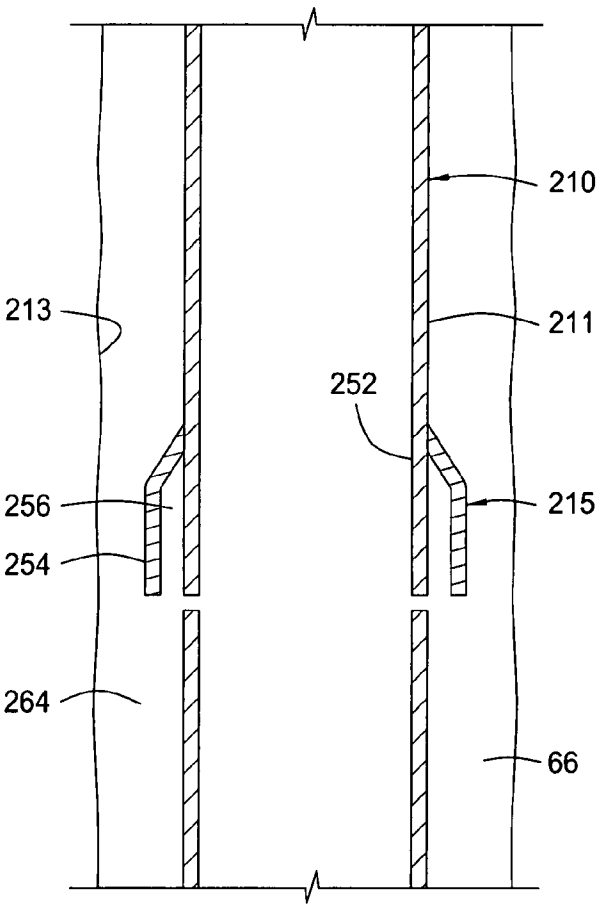
FIG. 13 illustrates the expandable tubular of FIG. 10 after it is cut.
Figure 12:
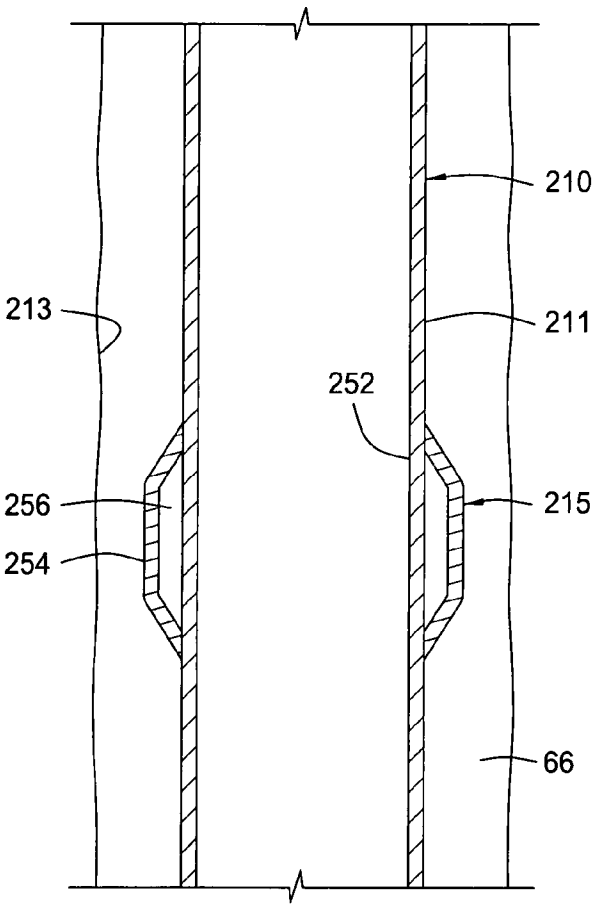
FIG. 12 illustrates the expandable tubular of FIG. 10 after expansion.

Referring now to FIGS. 11-14, the tubular 210 is located in the wellbore 213 and is radially expanded using an expansion tool such as a rotary expansion tool 262 as shown. Both the tube portion 211 and the body portion 215 of the tubular 210 are expanded initially, with the fluid within the annular chamber 256 transmitting the radial expansion forces to the outer wall 254 of the body portion to cause the outer wall to be expanded. FIG. 12 shows the tubular 210 after expansion. It can be seen that the outer wall 254 is now closer to the wellbore wall. Preferably, the expanded inner diameter of the inner wall 252 is substantially the same as the outer diameter of the tubing portion 211. Once the tubular 210 has been expanded, the expansion tool 262 is removed and a cement slurry 264 is injected into the annulus 66 formed between the tubular 210 and the wellbore 213. However, other embodiments of the present invention include supplying cement prior to or during expansion, forgoing use of cement, and providing an external seal on the tubular to form the seal instead of cement.

Where an incompressible cement is used and has set, further expansion to increase the outer diameter of the tubular 210 will be extremely difficult, if not impossible. However, due to the form of the body portion 215, the inner wall 252 may be radially expanded to form the oversized portion. Initially, the base of the walls 252, 254 is cut to separate from the lower portion of the tube portion, as illustrated in FIG. 13. Thereafter, the inner wall 252 is expanded into the chamber 256. This is achieved by inserting an expansion tool into the tubular 210 and activating the tool to expand the inner wall 252 and collapse the chamber 256.

Figure 14:
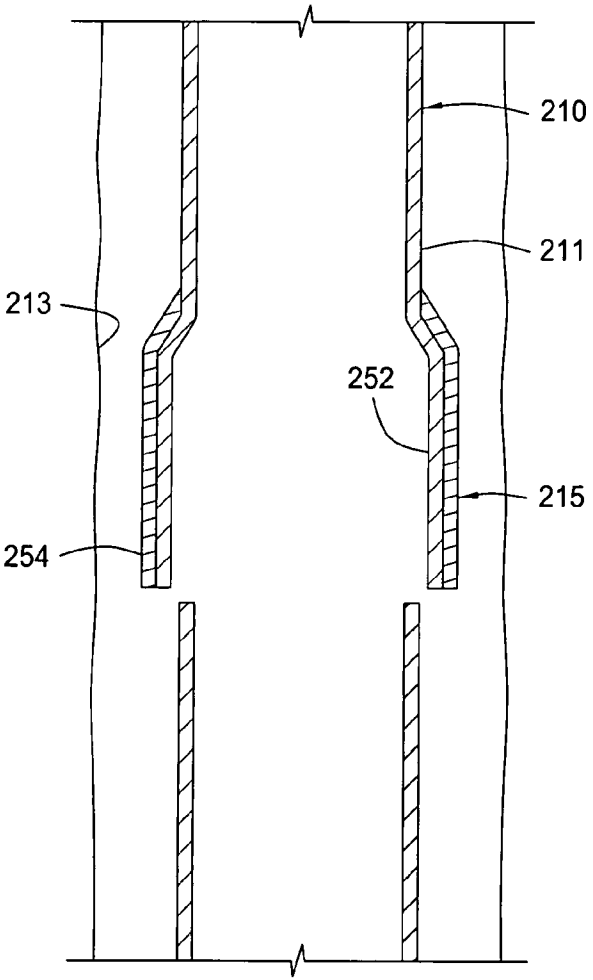
FIG. 14 illustrates the expandable tubular of FIG. 10 having an oversized portion formed therein.
Figure 17:
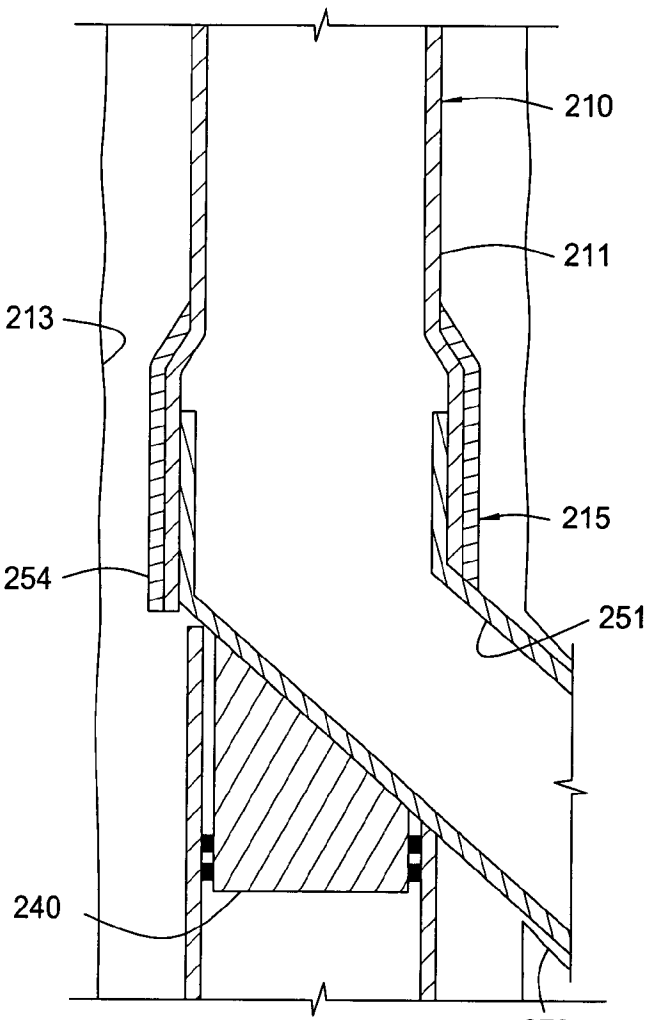
FIG. 17 illustrates lateral tubular lining the lateral wellbore shown in FIG. 16.

Once the inner wall has been expanded, the resulting body portion 215 will be in the form of an oversized portion, as shown in FIG. 14, wherein the inner diameter of the expanded body portion 215 is larger than the respective inner diameter of the tube portion 211. The ability to expand the inner wall 252 when the outer wall 254 is restrained is particularly advantageous where a further tubular is required to be hung or supported from tubular 210. In this case, the further tubular is expanded into the oversized portion of tubular 210 so that the resulting internal bore defined by both tubulars 210 is substantially uniform.

Figure 15:
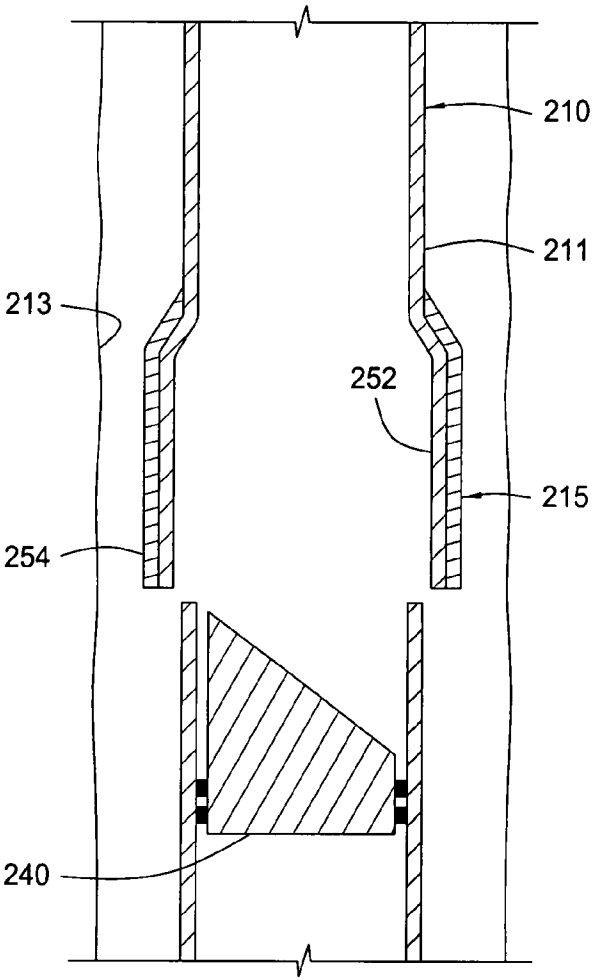
FIG. 15 illustrates a whipstock disposed in the expandable tubular of FIG. 10.
Figure 16:
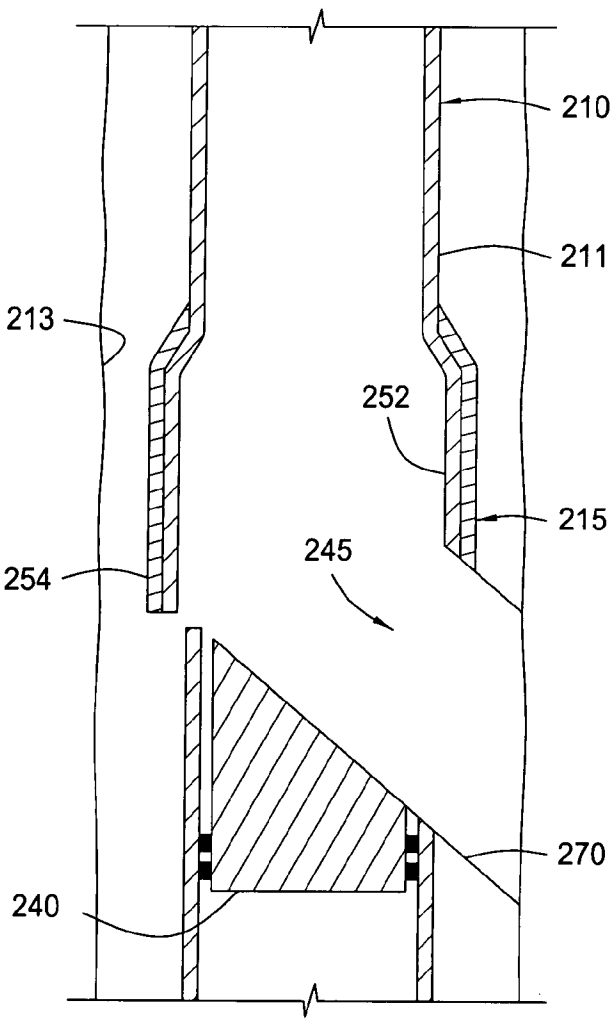
FIG. 16 illustrates a window and a lateral wellbore formed in the expandable tubular of FIG. 10.

After the oversized portion is formed, a monobore lateral wellbore may be installed. Referring now to FIGS. 15-16, a whipstock 240 is installed in the tubular 210 to facilitate the cutting of a window 245 for the sidetrack 270 through the tubular 210. In the preferred embodiment, the whipstock 240 is releasably attached to a lower end of the drill string (not shown) used to cut the window 45. In this respect, installation of the whipstock 240 and cutting of the window 245 can be performed in a single trip. After the whipstock 240 is installed, the drilling string is released from the whipstock 240 and the drilling member is actuated to cut the window 245 along a path directed by the whipstock 240. After the window 45 is formed, the drill string may continue to advance, thereby forming the lateral wellbore 70. An exemplary drill string and whipstock combination is disclosed in U.S. Pat. No. 6,454,007, issued on Sep. 24, 2002 to Bailey, which patent is herein incorporated by reference in its entirety. In another embodiment, the lateral wellbore may be drilled or extended in a second trip. It is contemplated that the window may be formed in any manner known to a person of ordinary skill in the art. In another embodiment, the tubular 210 may optionally include a profile for landing the whipstock or orienting the whipstock. In addition, the tubular 210 may optionally comprise a different material at the location of the window to facilitate the formation of the window.

After at least a portion of the lateral wellbore 270 has been formed, an expandable tubular 251 for lining the lateral wellbore 270 is inserted into the lateral wellbore 270. An upper portion of the tubular 251 is positioned in overlapping relationship with an oversized portion 215 of the tubular 210. The expandable tubular 251 is then expanded into the oversized portion 215, thereby forming the monobore with the tubular 10. In this manner, a monobore sidetrack may be formed.

In another embodiment, a plurality of discharge ports 260 is provided in the body portion 215, as shown in FIG. 11. The ports 260 allow the fluid 258 to be discharged from the chamber 256 when a predetermined fluid pressure is reached during an expansion process. Further expansion of the inner wall 252 is therefore achievable when the fluid 258 is discharged, collapsing the chamber 256 while substantially maintaining the outer diameter of the outer wall 254. Since the outer wall 254 is braced against the cement 264, the force of the expansion tool on the inner wall 252 will cause the pressure of the fluid 258 within the chamber 256 to increase beyond the predetermined opening pressure of the discharge ports 260, thus causing the fluid 258 to be vented. After the fluid 258 is released, the inner wall 252 is expanded, thereby collapsing the chamber 256. In this respect, it is no longer necessary to cut the base of the walls 252, 254 before expansion.

In another embodiment, a method of completing a lateral wellbore comprises inserting a first tubular into a main wellbore; forming an oversized portion on the first tubular, wherein the oversized portion has an outer diameter that is larger than an outer diameter of a non-oversized portion; and intersecting the lateral wellbore with the main wellbore. The method further includes inserting a second tubular into the lateral wellbore, wherein a portion of the second tubular is positioned adjacent the one or more oversized portions and expanding the portion of the second tubular adjacent the one or more oversized portions.

In another embodiment still, a method of forming a lateral wellbore comprises inserting a first tubular into a main wellbore; forming one or more oversized portions on the first tubular; expanding the first tubular; and forming a window in the first tubular. The method further comprises forming the lateral wellbore; inserting a second tubular into the lateral wellbore; and expanding a portion of the second tubular into sealing contact with the first tubular.

In another embodiment, an apparatus for completing a wellbore comprises a first tubular with a preformed oversized portion located away from an end of the first tubular, the oversized portion configured to engage an end of a second tubular, wherein the second tubular is expanded into engagement with the oversized portion.

In one or more of the embodiments described herein, an inner diameter of the transition area from the first tubular to the second tubular may be substantially uniform.

In one or more of the embodiments described herein, forming the one or more oversized portions comprises expanding an inner diameter of one or more portions of the first tubular.

In one or more of the embodiments described herein, the method further comprises expanding the first tubular and forming the one or more oversized portions on the expanded first tubular.

In one or more of the embodiments described herein, the one or more oversized portions is formed before the first tubular may be inserted into the main wellbore.

In one or more of the embodiments described herein, the one or more oversized portions is formed after the first tubular may be inserted into the main wellbore.

In one or more of the embodiments described herein, the one or more oversized portions may be formed after the first tubular is surrounded by cement.

In one or more of the embodiments described herein, the method further comprises providing the first tubular with a sleeve comprising a deformable material.

In one or more of the embodiments described herein, the one or more oversized portions may be formed adjacent the sleeve.

In one or more of the embodiments described herein, the one or more oversized portions may be formed by expanding the first tubular against the sleeve.

In one or more of the embodiments described herein, the method further comprises providing the first tubular with one or more dual wall sections.

In one or more of the embodiments described herein, the method further comprises expanding an inner wall of the one or more dual wall sections.

In one or more of the embodiments described herein, the method further comprises expanding an inner wall and an outer wall and subsequently further expanding the inner wall.

In one or more of the embodiments described herein, the method further comprises severing one of the one or more dual wall sections and expanding an inner wall.

In one or more of the embodiments described herein, the method further comprises disposing an incompressible fluid between an inner wall and an outer wall of the one or more dual wall sections.

In one or more of the embodiments described herein, the method further comprises disposing a deformable material between an inner wall and an outer wall of the one or more dual wall sections.

In one or more of the embodiments described herein, the method further comprises forming a window in a wall of the first tubular.

In one or more of the embodiments described herein, the method further comprises installing a whipstock in the first tubular for forming a window.

In one or more of the embodiments described herein, the method further comprises lowering a whipstock connected to a drilling member into the first tubular.

In one or more of the embodiments described herein, the method further comprises cutting a window in the first tubular.

In one or more of the embodiments described herein, the method further comprises forming the lateral wellbore.

In one or more of the embodiments described herein, the tubular includes a first end having a first outer diameter and a second end having a second diameter.

In one or more of the embodiments described herein, an outer diameter of the oversized portion is greater than both the first diameter and the second diameter.

While the foregoing is directed to embodiments of the present invention, other and further embodiments of the invention may be devised without departing from the basic scope thereof, and the scope thereof is determined by the claims that follow.

I claim:

1. A method of completing a lateral wellbore, comprising:
providing a dual wall section on a first tubular, wherein the dual wall section has an outer diameter that is larger than an outer diameter of a non-dual wall section;
inserting the first tubular having the dual wall section into a main wellbore;
severing the dual wall section;
expanding an inner diameter of the dual wall section, while substantially maintaining the outer diameter of the dual wall section;
forming the lateral wellbore and intersecting the lateral wellbore with the main wellbore
inserting a second tubular into the lateral wellbore, wherein a portion of the second tubular is positioned adjacent the expanded inner diameter of the dual wall section; and
expanding the portion of the second tubular adjacent the expanded inner diameter of the dual wall section.

2. The method of claim 1, further comprising expanding the first tubular.

3. The method of claim 1, wherein the dual wall section is expanded after the first tubular is surrounded by cement.

4. The method of claim 1, further comprising providing the first tubular with an external seal.

5. The method of claim 4, wherein the external seal is provided on the outer diameter of the dual wall section.

6. The method of claim 1, further comprising providing the first tubular with one or more additional dual wall sections.

7. The method of claim 6, further comprising expanding an inner wall of the one or more additional dual wall sections.

8. The method of claim 6, further comprising expanding an inner wall and an outer wall of the one or more additional dual wall sections.

9. The method of claim 6, further comprising severing one of the one or more additional dual wall sections.

10. The method of claim 9, further comprising expanding an inner wall of the one or more additional dual wall sections.

11. The method of claim 1, further comprising disposing an incompressible fluid between an inner wall and an outer wall of the dual wall section.

12. The method of claim 1, further comprising disposing a deformable material between an inner wall and an outer wall of the dual wall section.

13. The method of claim 1, further comprising forming a window in a wall of the first tubular.

14. The method of claim 1, further comprising installing a whipstock in the first tubular for forming a window.

15. The method of claim 14, further comprising cutting the window in the first tubular.

16. The method of claim 1, wherein an inner diameter of a transition area from the first tubular to the second tubular is substantially uniform.

17. The method of claim 1, wherein the dual wall section is located at a middle section of the first tubular, along a longitudinal length of the first tubular.

18. The method of claim 1, further comprising supplying a cement slurry prior to expanding the inner diameter of the dual wall section.

19. A method of forming a lateral wellbore, comprising:
inserting a first tubular into a main wellbore;
providing the first tubular with a dual wall section;
expanding the dual wall section, thereby forming an oversized portion on the first tubular;
expanding the first tubular;
severing the dual wall section;
forming a window in the first tubular;
forming the lateral wellbore;

inserting a second tubular into the lateral wellbore; and expanding a portion of the second tubular into sealing contact with the oversized portion on the first tubular.

20. The method of claim 19, wherein an inner diameter of a transition area from the first tubular to the second tubular is substantially uniform.

21. The method of claim 19, wherein forming the oversized portion comprises expanding an inner diameter of one or more portions of the first tubular.

22. The method of claim 19, wherein the oversized portion is formed adjacent an external seal.

23. The method of claim 19, wherein the oversized portion is expanded against an external seal.

24. The method of claim 19, further comprising providing the first tubular with one or more additional dual wall sections.

25. The method of claim 19, further comprising expanding an inner wall of the dual wall section.

26. The method of claim 19, further comprising disposing an incompressible fluid between an inner wall and an outer wall of the dual wall section.

27. The method of claim 19, further comprising disposing a deformable material between an inner wall and an outer wall of the dual wall section.

28. The method of claim 19, wherein the oversized portion has an outer diameter that is larger than an outer diameter of a non-oversized portion.

29. The method of claim 19, wherein an inner diameter of the second tubular is substantially equal to an inner diameter of the first tubular.

30. The method of claim 19, further comprising providing a cement slurry around the dual wall section before expansion of the dual wall section.

31. The method of claim 19, wherein an outer surface of the dual wall section has an external seal that includes flutes.

32. A method of completing a lateral wellbore, comprising:

inserting a first tubular into a main wellbore, wherein the first tubular includes a dual wall section having an inner wall, an outer wall, and a chamber between the inner and outer walls;

expanding the inner and outer walls;

severing a base of the inner and outer walls to separate a lower portion of the first tubular from the dual wall section after expansion of the inner and outer walls;

expanding the inner wall into contact with the outer wall, thereby collapsing the chamber;

forming the lateral wellbore and intersecting the lateral wellbore with the main wellbore;

inserting a second tubular into the lateral wellbore, wherein a portion of the second tubular is positioned adjacent the expanded inner wall; and expanding the portion of the second tubular into contact with the expanded inner wall so that an inner diameter of the expanded portion of the second tubular is substantially equal to an inner diameter of the first tubular.

33. The method of claim 32, wherein the dual wall section is located at a middle section of the first tubular.

34. The method of claim 32, wherein an incompressible fluid is disposed in the chamber.

35. The method of claim 34, wherein the incompressible fluid transmits a force on the outer wall to partially expand the outer wall, while expanding the inner wall.

36. The method of claim 34, wherein the incompressible fluid is released from the chamber upon severing of the base of the inner and outer walls.

37. The method of claim 32, wherein a deformable material is disposed in the chamber.

38. The method of claim 37, wherein the deformable material transmits a force on the outer wall to partially expand the outer wall, while expanding the inner wall.

39. The method of claim 37, wherein the deformable material is released from the chamber upon severing of the base of the inner and outer walls.

40. A method of forming a lateral wellbore, comprising:

inserting a first tubular into a main wellbore;

providing a portion of the first tubular with a dual wall section;

cementing the first tubular in the main wellbore severing the dual wall section;

expanding the portion of the first tubular after the first tubular is cemented in the main wellbore;

forming a window in the first tubular;

forming the lateral wellbore;

inserting a second tubular into the lateral wellbore; and expanding a portion of the second tubular into sealing contact with the expanded portion of the first tubular.

41. The method of claim 40, wherein the portion of the first tubular is expanded into a deformable material of the dual wall section, thereby deforming the deformable material.

* * * * *